US008306765B2

(12) United States Patent
Egan

(10) Patent No.: US 8,306,765 B2
(45) Date of Patent: Nov. 6, 2012

(54) METHOD AND DEVICE FOR ACOUSTIC LENGTH TESTING OF COMPRESSOR

(75) Inventor: William C. Egan, Menasha, WI (US)

(73) Assignee: Nuovo Pignone Holding S.p.A., Florence (IT)

( * ) Notice: Subject to any disclaimer, the term of this patent is extended or adjusted under 35 U.S.C. 154(b) by 787 days.

(21) Appl. No.: 12/338,086

(22) Filed: Dec. 18, 2008

(65) Prior Publication Data

US 2010/0161285 A1 Jun. 24, 2010

(51) Int. Cl.
*G06F 17/40* (2006.01)
*G06F 17/00* (2006.01)

(52) U.S. Cl. ..... 702/76; 702/75; 73/114.16

(58) Field of Classification Search ..... 702/191, 702/39, 75, 76, 113, 114
See application file for complete search history.

(56) References Cited

U.S. PATENT DOCUMENTS 5,455,772 A * 10/1995 Burke et al. ..... 701/99
2005/0106036 A1* 5/2005 Jay et al. ..... 417/312
2006/0237081 A1* 10/2006 Lucas et al. ..... 138/39

* cited by examiner

*Primary Examiner* — Hal Wachsman
(74) *Attorney, Agent, or Firm* — Potomac Patent Group PLLC

(57) ABSTRACT

Computer system and method for determining frequencies of various components of a volume choke volume dampener to be attached to a compressor. The method includes determining a sound spectrum of a cavity of the compressor without attaching the dampener to the compressor; calculating an acoustic wavelength of the cavity; receiving a length of a proximal nozzle of the dampener; and calculating, based on the acoustic wavelength of the cavity and the length of the proximal nozzle of the dampener, multiple order frequencies associated with the proximal nozzle of the dampener and the cavity of the compressor, wherein the proximal nozzle of the dampener is proximal to the cavity of the compressor when the dampener is attached to the compressor.

20 Claims, 10 Drawing Sheets

FIG. 5

Cambell Diagram of Acoustic Frequencies

| Nozzle frequencies | | Discharge Hz |
|---|---|---|
| n=1 | | 37.8 |
| n=3 | | 113.3 |
| n=5 | | 188.8 |
| n=7 | | 264.4 |
| n=9 | | 339.9 |

| Chamber length frequencies | Discharge Hz |
|---|---|
| n=1 | 256.5 |
| n=2 | 513.0 |
| n=3 | 769.5 |
| n=4 | 1026.0 |
| n=5 | 1282.5 |
| n=6 | 1539.0 |
| n=7 | 1795.5 |

| 3-D Cross-wall frequencies Lamda | |
|---|---|
| 0.586 | 512.7 |
| 0.972 | 850.4 |
| 1.219 | 1066.5 |
| 1.337 | 1169.7 |

| Choke tube frequencies | Hz |
|---|---|
| n=1 | 261.7 |
| n=2 | 523.5 |
| n=3 | 785.2 |
| n=4 | 1046.9 |
| n=5 | 1308.6 |
| n=6 | 1570.4 |
| n=7 | 1832.1 |

Rotor Speeds

| Male | Min | MCOS Max | 120% MCOS |
|---|---|---|---|
| RPM | 0 | 6811.0 | 6950.0 |
| 1 X Lobe Pass (Hz) | 0 | 454.1 | 463.3 |
| 2 X Lobe Pass (Hz) | 0 | 908.1 | 926.7 |
| 3 X Lobe Pass (Hz) | 0 | 1362.2 | 1390.0 |
| 4 X Lobe Pass (Hz) | 0 | 1816.3 | 1853.3 |

| Female | Min | Max | |
|---|---|---|---|
| RPM | 0 | 4540.7 | 4633.3 |

| | | | |
|---|---|---|---|
| Maximum Plot Frequency Range (Max) | | 1098.0 | Hz |
| | Min | 0 | Hz |

METHOD AND DEVICE FOR ACOUSTIC LENGTH TESTING OF COMPRESSOR

TECHNICAL FIELD

The present invention generally relates to systems, software and methods and, more particularly, to mechanisms and techniques for acoustic length testing of a compressor.

BACKGROUND

Various industries are making use of compressors for pumping, for example, refinery or chemical plants, either to the users or from the producers. There are many industrial applications that require the use of Oil Free Screw (OFS) compressors. An OFS compressor, as the name explains, does not have oil in contact with the screws. However, all these industries share a common problem when using positive displacement OFS compressors, i.e., the occurrence of noise and vibration in the compressors and/or the piping associated with the compressors. A positive displacement compressor is a compressor that may provide a constant volume output. As will be discussed next, vibration due to acoustic resonances may damage or destroy the compression equipment and its supporting process piping and thus should be attenuated and/or eliminated if possible.

In large diameter piping, for example, high-frequency energy can produce excessive noise and vibration, and failures of thermowells, instrumentation, and attached small-bore piping. In severe cases, the pipe itself can fracture. The same is true for the compressors attached to the piping. These problems most often manifest themselves in, screw compressors, and silencers. In the following the screw compressors are discussed for simplicity. A screw compressor typically has two rotors, a male and female rotor. The lobe combination of the rotors can vary as the design intent varies (3×5, 4×6, 6×8).

Two high-frequency energy generation mechanisms predominate in most industrial processes: flow induced (vortex shedding) and pulsation at multiples of running speed (blade-pass in centrifugal compressors and pocket-passing or lobe passing frequency in screw compressors). For the screw compressors, the intermeshing of the helical lobes generates pulsation at the pocket-passing frequency, which is equal to the number of lobes on the male rotor multiplied by the compressor running speed. Normally, the maximum pulsation amplitude occurs at the fundamental pocket-passing frequency. The amplitudes of the higher multiples are typically but not always lower than the amplitude of the primary pocket-frequency. Once this energy is generated, amplification may occur from acoustical and/or structural resonances, resulting in high amplitude vibration and noise.

Silencers may be attached to the inlet and/or outlet of the compressors to reduce the dynamic pressures and noise discussed above. An example of an inlet silencer (dampener) and an outlet silencer attached to a compressor is shown in FIG. 1. The silencers shown in FIG. 1 are volume choke volume type. FIG. 1 shows a compressor system 10 that includes a compressor 20, an inlet pulsation dampener 30 and a discharge pulsation dampener 50. A gas flows into the dampener 30 as indicated by arrow A and the compressed gas flows out of the dampener 50 as indicated by arrow B. The compressor 20 includes, among other things, an inlet cavity 22 and an outlet cavity 24. The inlet cavity 22 has a flange 26, which is connected to the inlet dampener 30 while the outlet cavity has a flange 28, which is connected to the discharge dampener 50.

The inlet dampener 30 has a nozzle 32 characterized by a nozzle length NL. Connected to the nozzle 32, is a cavity 34 that includes a choke tube 36. The cavity 34 has an upper portion 37 characterized by a λ or cross wall length 38 and an axial chamber length 40. The choke tube 36 has a length 42. The inlet dampener 30 has a flange 44 that is connected to the flange 26 of the compressor 20.

The discharge dampener 50 includes a nozzle 52 connected to a cavity 54, that includes a choke tube 56. An axial chamber 58 of the cavity 54, which is directly connected to the nozzle 52, has a length 60 and a λ or cross wall length 62. The nozzle 52 has a nozzle length NL and the choke tube 56 has a length 64. A flange 66 is attached to the nozzle 52 for connecting the nozzle 52 to the flange 28 of the compressor 20. Such a dampener that has a volume 58, a choke 56 and another volume (not labeled) is called a volume choke volume dampener.

However, the dampeners and their components (nozzle, axial chamber, choke tubes, etc.,) need to be sized appropriately to ensure acoustic resonances are not generated within the silencer. This will ultimately result in the reduction in vibration and/or noise. Accordingly, it would be desirable to provide devices and methods that avoid the afore-described problems and drawbacks.

SUMMARY

According to one exemplary embodiment, there is a method for determining frequencies of various components of a dampener to be attached to a compressor. The method includes determining a sound spectrum of a cavity of the compressor without attaching the dampener to the compressor; calculating an acoustic wavelength of the cavity; receiving a length of a proximal nozzle of the dampener; and calculating, based on the acoustic wavelength of the cavity and the length of the proximal nozzle of the dampener, multiple order frequencies associated with the proximal nozzle of the dampener and the cavity of the compressor, wherein the proximal nozzle of the dampener is proximal to the cavity of the compressor when the dampener is attached to the compressor.

According to another exemplary embodiment, there is a computer readable medium including computer executable instructions, where the instructions, when executed, implement a method for determining frequencies of various components of a dampener to be attached to a compressor. The method includes providing a system comprising distinct software modules, wherein the distinct software modules comprise a frequency calculation module, a special calculation module, and an acoustic Campbell module; determining a sound spectrum of a cavity of the compressor without attaching the dampener to the compressor; calculating by the frequency calculation module an acoustic wavelength of the cavity; receiving a length of a proximal nozzle of the dampener; and calculating by the special calculation module, based on the acoustic wavelength of the cavity and the length of the proximal nozzle of the dampener, multiple order frequencies associated with the proximal nozzle of the dampener and the cavity of the compressor, wherein the proximal nozzle of the dampener is proximal to the cavity of the compressor when the dampener is attached to the compressor.

According to still another exemplary embodiment, there is a computer system for determining frequencies of various components of a dampener to be attached to a compressor. The computer system includes a processor configured to determine a sound spectrum of a cavity of the compressor without attaching the dampener to the compressor, calculate an acoustic wavelength of the cavity, receive a length of a proximal nozzle of the dampener, and calculate, based on the acoustic wavelength of the cavity and the length of the proximal nozzle of the dampener, multiple order frequencies associated with the proximal nozzle of the dampener and the cavity of the compressor, wherein the proximal nozzle of the dampener is proximal to the cavity of the compressor when the dampener is attached to the compressor.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 5 illustrates input data for a Campbell diagram module according to an exemplary embodiment;

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of an OFS positive displacement compressor. Among the various types of compressors used in industrial processing plants, the screw compressors have two screws or rotors with helical lobes that mesh with each other, so as to create a cavity that progressively moves from the intake area to the delivery area of the compressor, thus compressing the fluid. Also for simplicity, a volume choke volume dampener is discussed. However, the embodiments to be discussed next are not limited to these compressors and dampeners but may be applied to other existing compressors.

Reference throughout the specification to "one embodiment" or "an embodiment" means that a particular feature, structure, or characteristic described in connection with an embodiment is included in at least one embodiment of the present invention. Thus, the appearance of the phrases "in one embodiment" or "in an embodiment" in various places throughout the specification is not necessarily all referring to the same embodiment. Further, the particular features, structures or characteristics may be combined in any suitable manner in one or more embodiments.

While providing dampeners to the inlet and discharge cavities of the compressor are know in the art, methods and systems for sizing these dampeners to reduce vibration and/or noise that might appear in the compressor and associated equipment are not so effective. Thus, the following exemplary embodiments disclose novel methods and systems for determining appropriate shapes and sizes of the dampeners components for achieving vibration and/or noise reduction.

Figure 2:
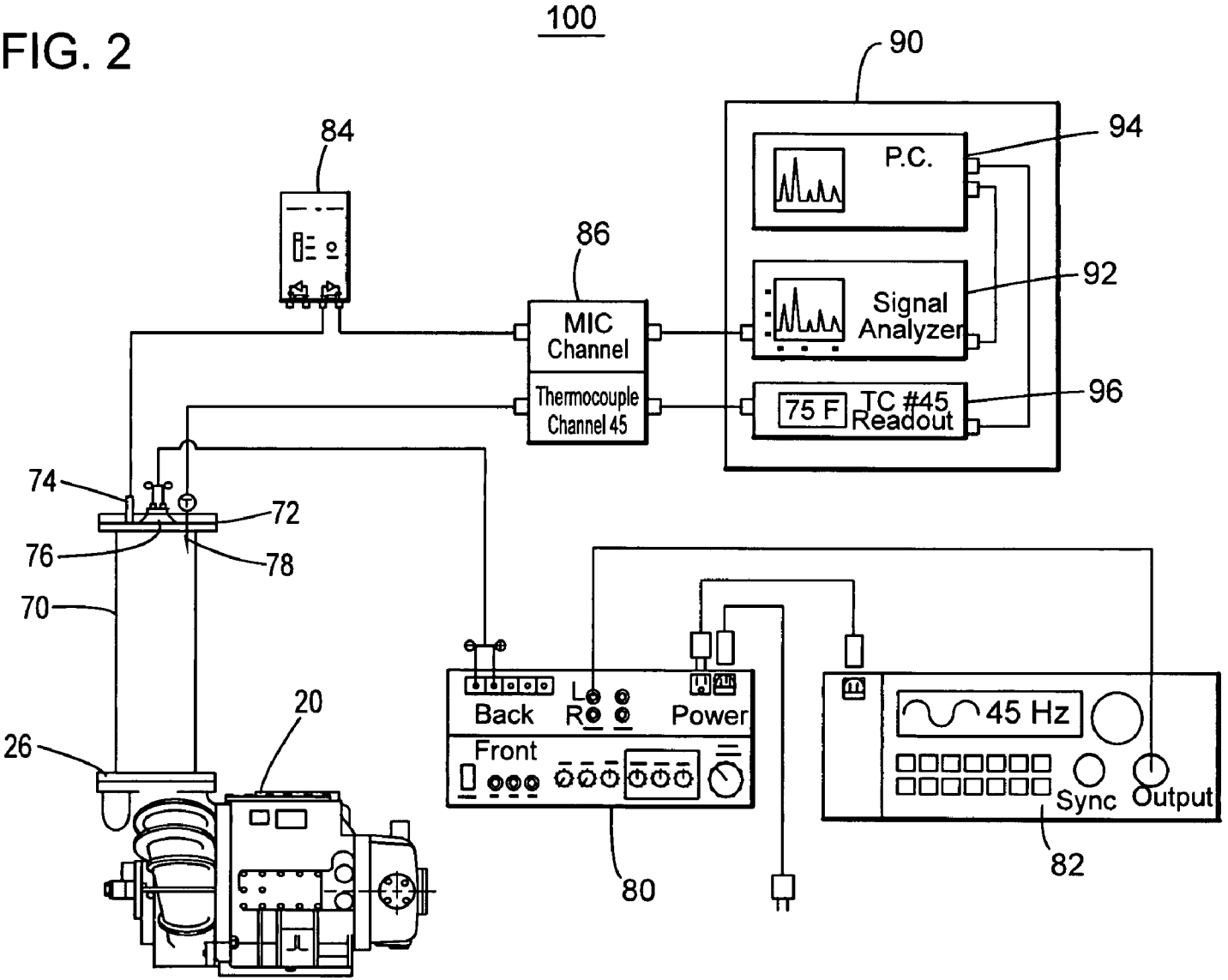
FIG. 2 is a schematic diagram of a testing system attached to a compressor according to an exemplary embodiment.

According to an exemplary embodiment, a system for measuring an acoustic length of the compressor is shown in FIG. 2. FIG. 2 shows an acoustic length measuring system 100 installed on the compressor 20. A pipe 70 is attached between the flange 26 of the compressor 20 and a measuring flange 72. It is noted that the inlet dampener 30 and the discharge dampener 50 are removed from the compressor 20. A microphone 74, a speaker 76 and a thermocouple 78 are all attached to the measuring flange 72. The pipe 70 may have, according to an exemplary embodiment, a length larger than five times its diameter. A diameter of the pipe 70, in one application, is substantially equal to a diameter of the flange 26 of the compressor 20.

The speaker 76 may be connected to an amplifier 80, as shown in FIG. 2. The amplifier 80 may be a known amplifier that is capable of producing a sound signal having a frequency from 0 to 10 k Hz. The amplifier 80 may be connected to a function generator device 82. The function generator device 82 is configured to generate a desired function, for example, a sine wave.

The sound generated by the speaker 76 propagates into the pipe 70 and the inlet cavity 22 of the compressor 20. A reflected sound is captured by the microphone 74 and provided to a control device 90. A power supply 84 might supply the required power to microphone 74. The captured sound signal may be passed through a mic channel of an instrumentation boom 86 prior to being delivered to the control device 90. The thermocouple 78 is disposed inside the pipe 70 to measure a temperature of the air inside the pipe. The temperature signal is provided to the control device 90 via the instrumentation boom 86 and will be used to calculate the acoustic sound speed.

When determining the acoustic length of the compressor 20, the compressor 20 is not activated, i.e., the rotors are at rest, and no liquid or gas is circulated through the compressor 20, i.e., only air is present inside the compressor. According to another exemplary embodiment, the compressor may by activated and a gas or liquid may be circulated inside the compressor 20 when determining the acoustic length.

Although FIG. 2 shows the measuring system 100 measuring the acoustic length of the inlet cavity 22 of the compressor 20, the same measuring system 100 may be used to measure the discharge cavity 24 of the compressor 20. For simplicity, only the measuring of the acoustic length of the inlet cavity 22 is shown and discussed in the following embodiments.

The control device 90 may include a signal analyzer 92 that is configured to analyze and determine the sound signal recorded by the microphone 74, a computer system 94 for extracting and calculating (as will be discussed next) various quantities from the recorded sound signal, and a temperature transducer 96 for providing a temperature signal to the computer system 94.

Figure 3:
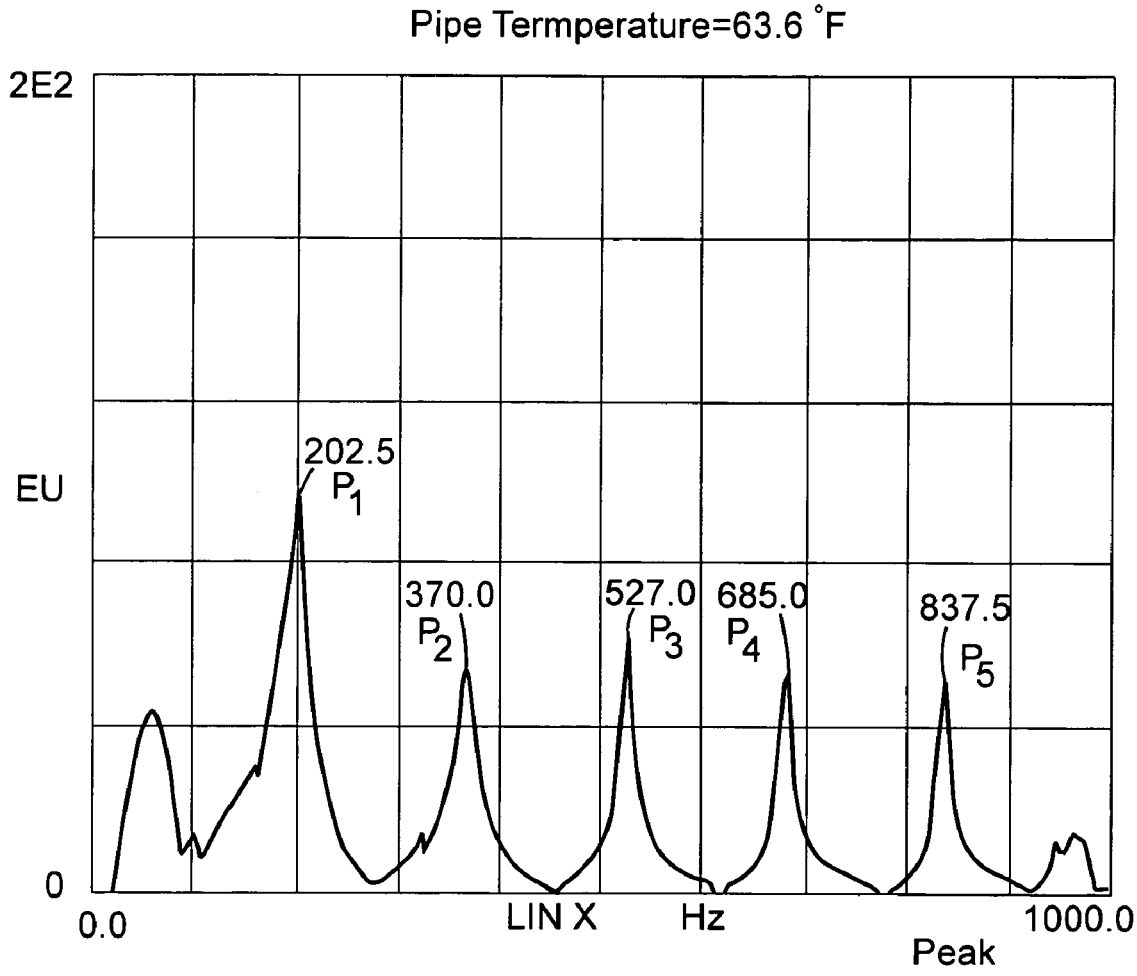
FIG. 3 is a graph of a sound spectrum recorded by the testing system of FIG. 2 according to an exemplary embodiment.

Having (i) the sound spectrum recorded by the microphone in response to the sound sweep generated by the speaker and (ii) the temperature of the air recorded by the thermocouple inside the pipe 70, the following processes may take place in the computer system 94. An example of the recorded sound spectrum is shown in FIG. 3, in which the sound energy (intensity) is recorded versus the frequency f at 63.6 F. A plurality of peaks p1 to p5 are identified in the spectrum. In this exemplary embodiment, a sound having a frequency range from 0 to 1000 Hz has been emitted. The spectrum is analyzed by the signal analyzer 92 and the peaks p1 to p5 are provided to the computer system 94.

Figure 4:
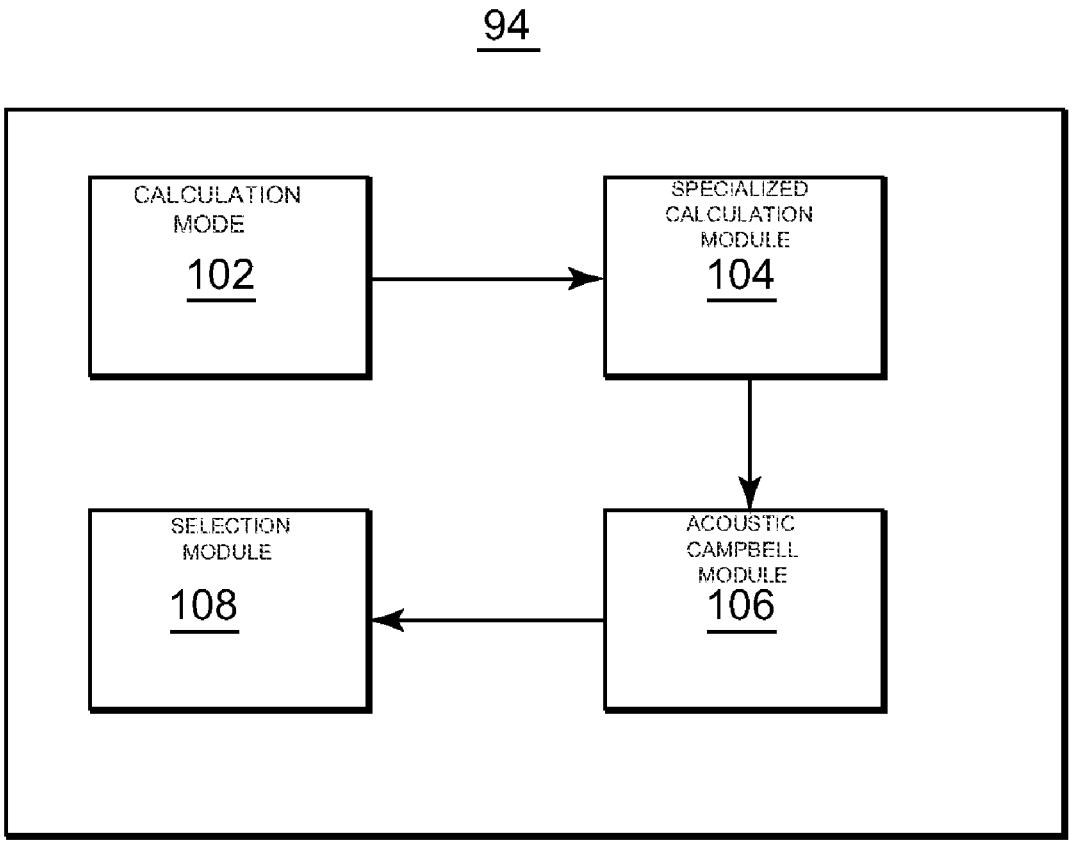
FIG. 4 is a schematic diagram of a computing system that is part of the testing system according to an exemplary embodiment.

As shown in FIG. 4, the computer system 94 may include a frequency calculation module 102 that is configured to calculate an acoustic velocity and the differences between each two consecutive peaks p1 to p5. The acoustic sound speed is calculated based on a constant ns of the air, a molecular weight of the air, the temperature of air in the pipe 70 and a compressibility Z of the air. According to an exemplary embodiment, the acoustic sound speed is calculated as sqrt [(K1×ns)×(K2/molecular weight)×(T+K3)×Z], where sqrt is the square root operation, and K1 to K3 are constants. By calculating the differences between each two consecutive peaks p1 to p5, plural frequency differences Δf are obtained. The calculation module 102 is also configured to calculate an average of the frequency differences Δf to produce an average frequency difference $\Delta f_{ave}$. A ½ wavelength is calculated by dividing the acoustic speed by twice the $\Delta f_{ave}$. By calculating the difference between the ½ wave and the length of the pipe 70, the effective acoustic length of the inlet cavity 22 of the compressor 20 is obtained. The effective acoustic length of the discharge cavity 24 of the compressor 20 may be calculated in a similar way.

The above data is fed by the frequency calculation module 102 to a specialized calculation module 104, which is configured to calculate at least one of nozzle frequencies, 3-D chamber cross wall frequencies, axial chamber frequencies, and choke tube frequencies. In one application, the nozzle frequencies (orders 1, 3, 5, 7, and 9) are calculated as described next. The compressor cavity effective acoustic length (which was calculated by unit 102) is added to a spool piece length of the spool piece between the dampener and the compressor (if one exists in the system otherwise the dampener nozzle length is used), and to a dampener nozzle physical length of the nozzle 32 and the sum is multiplied by a constant to produce an overall nozzle effective length. By dividing the acoustic speed with the overall nozzle effective length, an exact match excitation frequency of order n=1 for the nozzle is obtained. The remaining orders are obtained by multiplying the exact match excitation frequency with the number corresponding to the order. Multiple lobe pass frequencies may be calculated by dividing corresponding exact match excitation speed (which are obtained by dividing the exact match excitation frequencies with the number of lobes of the male screw and multiplying by 60) by the rated speed of the screw. A similar calculation may be provided for the nozzle with a pseudo extension with the only difference that the length of the pseudo extension has to be added to the overall nozzle effective length. The pseudo extension may be used as an extension to the physical geometry to allow for more accurate acoustic prediction.

Figure 1:
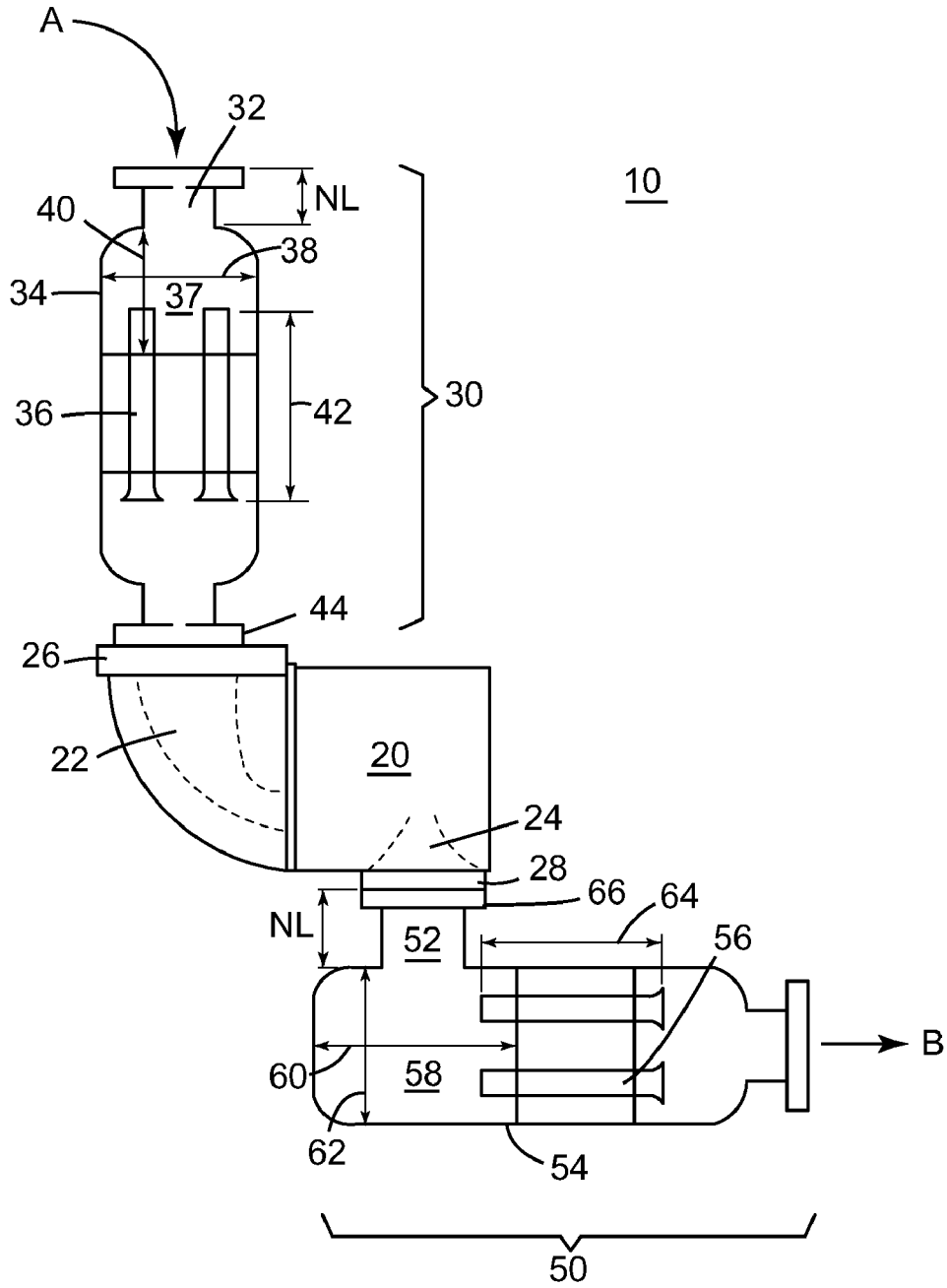
FIG. 1 PRIOR ART
FIG. 1 is a schematic diagram of a compressor system that includes an inlet dampener, a compressor, and a discharge dampener.

According to another exemplary embodiment, an exact match excitation frequency for the 3-D chamber cross wall is calculated by multiplying a value λ (62 in FIG. 1) of the cross wall with the acoustic speed and dividing the product by a diameter of the chamber shell (38 or 62 in FIG. 1). Multiple lobe pass frequencies may be calculated by dividing corresponding exact match excitation speeds (which are obtained by dividing the exact match excitation frequencies with the number of lobes of the male screw and multiplying by 60) by the rated speed of the screw.

According to another exemplary embodiment, an exact match excitation frequency for the axial chamber may be calculated by dividing the acoustic speed with twice the axial length 60 (shown in FIG. 1). Multiple lobe pass frequencies may be calculated by dividing corresponding exact match excitation speeds (which are obtained by dividing the exact match excitation frequencies with the number of lobes of the male screw and multiplying by 60) by the rated speed of the screw According to another exemplary embodiment, a primary exact match excitation frequency for the choke tube may be calculated by dividing the acoustic speed with twice the overall choke tube effective length 64 (shown in FIG. 1). Multiple lobe pass frequencies may be calculated by dividing corresponding exact match excitation speeds (which are obtained by dividing the exact match excitation frequencies with the number of lobes of the male screw and multiplying by 60) by the rated speed of the screw.

Figure 6:
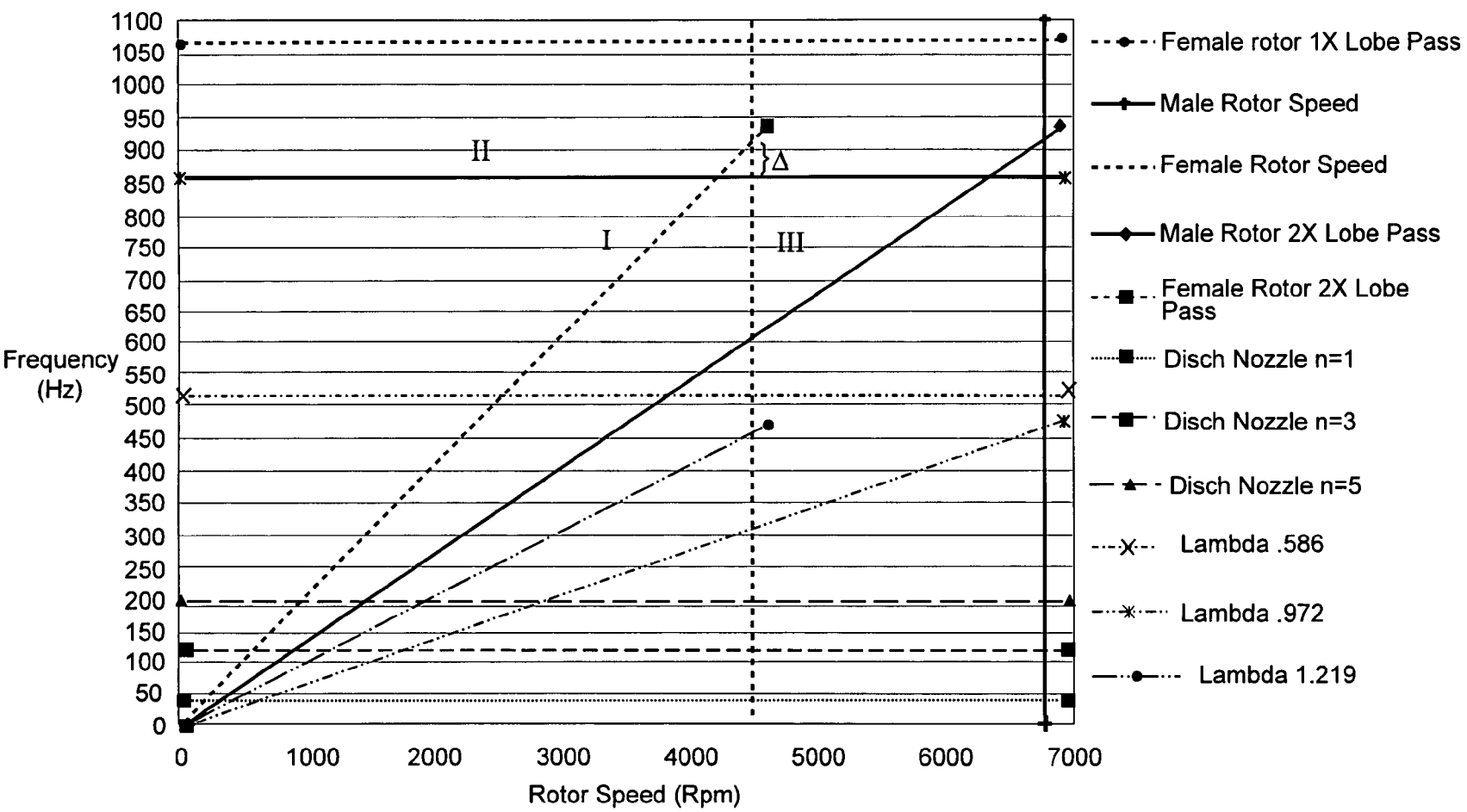
FIG. 6 is a graph showing frequencies of various components of the compressor system according to an exemplary embodiment.

The data calculated by module 104 based on the steps described above is sent to the acoustic Campbell module 106 for further processing and display. An example of such data is shown in FIG. 5. Still for exemplary purposes, part of the data shown in FIG. 5 is plotted by the acoustic Campbell module 106 as shown in FIG. 6, which is an acoustic Campbell Diagram. It is noted that the data shown in FIGS. 5 and 6 is not limiting the exemplary embodiments as this data is compressor specific. In other words, each compressor has its own characteristics and there is no set of data that can describe different compressors. Even more, the dampeners attached to the compressors are different and the data shown in FIGS. 5 and 6 take into account not only the characteristics of the compressor but also of the dampeners to be attached to the compressor. Further, FIG. 5 indicates specific speeds of the male and female screws, which may be different from compressor to compressor and also for the same compressor depending of the gas or liquid to be compressed.

Having clarified that the numbers shown in FIGS. 5 and 6 are exemplary, FIG. 6 shows the first three orders of the nozzle frequencies and the first three orders of the cross-wall frequencies (the horizontal lines), the male rotor speed and the female rotor speed (vertical lines) and the first two orders of the male and female lobe pass frequencies. As discussed previously, the male and female lobe pass frequencies are calculated by multiplying the speed of the corresponding rotor by the corresponding number of lobes and also by the order of the frequency, i.e., n=1, 3, 5, 7, etc.

Based on the data shown in the acoustic Campbell diagram of FIG. 6, a selection module 108 or an operator of the computing system 94 may decide various modifications to be implemented to the components of the inlet and discharge dampeners for having their frequencies spaced apart from the acoustic pocket frequencies and/or resonant frequencies of the dampener. The natural resonance frequencies are predicted values that occur within the compressor silencer system. Some or all the acoustic resonances may be plotted as horizontal lines in the Campbell diagram of FIG. 6. These resonant frequencies may include nozzle, choke tube, cross wall and axial frequencies. According to an exemplary embodiment, the acoustic frequencies of the dampeners shown in FIG. 5 are desired to be spaced from the resonant lobe pass or pocket pass frequency by at least 20%. This means, according to this exemplary embodiment, that if curve I (female rotor 2× lobe pass frequency) in FIG. 6 is closer than a predetermined value to curve II (cross-wall frequencies) at the speed defined by curve III (A in FIG. 6) the cross-wall size 38 or 62 in FIG. 1 of the dampeners have to be modified for avoiding the occurrence of the vibration and/or noise in the compressor when the compressor is functional. According to an exemplary embodiment, the percentage difference between an excitation frequency and an acoustic natural frequency is calculated as follows: (acoustic natural frequency–excitation frequency)/excitation frequency times 100. This number is desirable to be larger than 20%.

Figure 7:
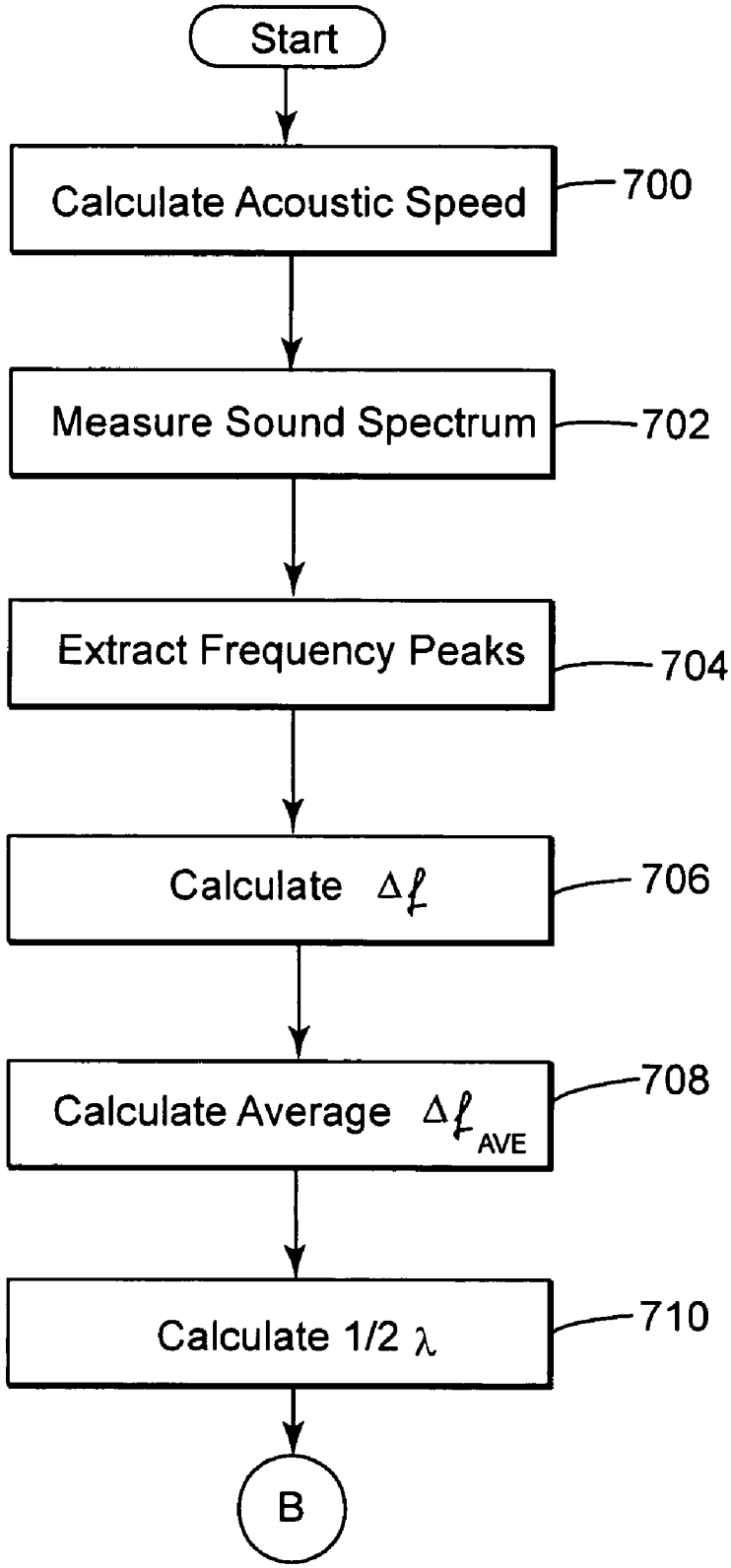
FIGS. 7 and 8 are flow charts illustrating steps of a method for calculating the frequencies shown in FIG. 6 according to an exemplary embodiment.
Figure 8:
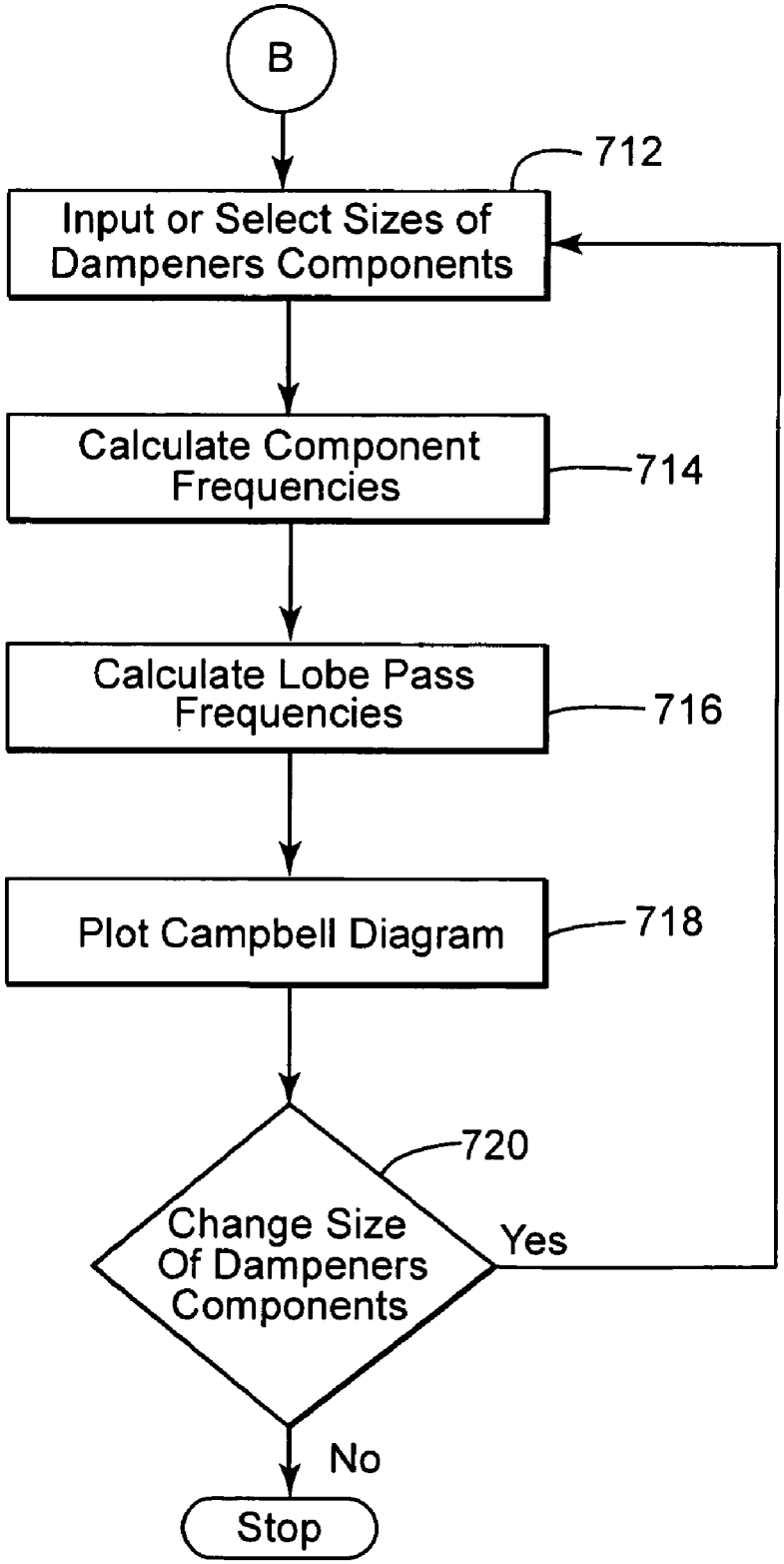

As would be appreciated by those skilled in the art, based on exemplary FIG. 6, there are various sizes and arrangements of the dampeners that may be modified for having the nozzle, cross-wall, chamber length and choke tube frequencies distributed away from the lobe pass frequencies, and these sizes and arrangements are compressor specific. This silencer type is volume choke volume type Thus, the steps of a method for determining the distribution of the frequencies of the various components of the compressor system 10 of FIG. 1 are discussed next with regard to FIGS. 7 and 8. In step 700, the acoustic sound speed for the pipe 70 (FIG. 2) and the inlet cavity 22 or discharge cavity 24 (FIG. 1) is calculated. This step involves measuring the temperature of the air and either receiving from the operator or looking up in a table the molecular weight, compressibility, and ns index of the gas used, in this case air. In step 702, the sound spectrum (discussed with regard to FIG. 2) is measured and analyzed. In step 704, the peak frequencies are extracted from the sound spectrum and the differences $\Delta f$ are calculated between the adjacent peaks. In step 706 the average $\Delta f_{ave}$ is calculated and, based on this value and the acoustic speed measured in step 700, the $\frac{1}{2}\lambda$ is calculated in step 710.

Based on sizes of the components of the dampeners that are input or lookout out in an existing file in step 712, the frequencies associated with the dampeners are calculated in step 714. These frequencies may be the nozzle frequencies, cross-wall frequencies, chamber length frequencies, choke tube frequencies, etc. In step 716 the system may calculate the lobe pass frequencies, which depend on the speed of the corresponding rotor. The frequencies calculated in steps 714 and 716 may be displayed as an acoustic Campbell diagram in step 718. In step 720, either the user or a computer software installed in a computer system determines whether the frequencies calculated in step 714 are far enough from the frequencies calculated in step 716 and/or a natural resonance frequency of the compressor. If the frequencies calculated in step 714 are not far enough, the dampeners and compressor will be affected by the lobe pass frequencies. Thus, the operator or the computer system may select other sizes for the components of the dampeners in step 712 after which the steps 714 to 720 may be repeated until a desired spread of the frequencies is achieved. When the selected sizes in step 712 produces good results in step 720, the process stops.

Thus, according to these specific steps that may be implemented in the control system 94 shown in FIG. 4, the components of the inlet and discharge dampeners may be selected to ensure minimal influence of the lobe pass frequencies and/or other resonance frequency of the compressor. Therefore, the specific steps shown in FIGS. 7 and 8 configure the computing device of FIG. 4 in a specific manner for achieving this result.

Figure 9:
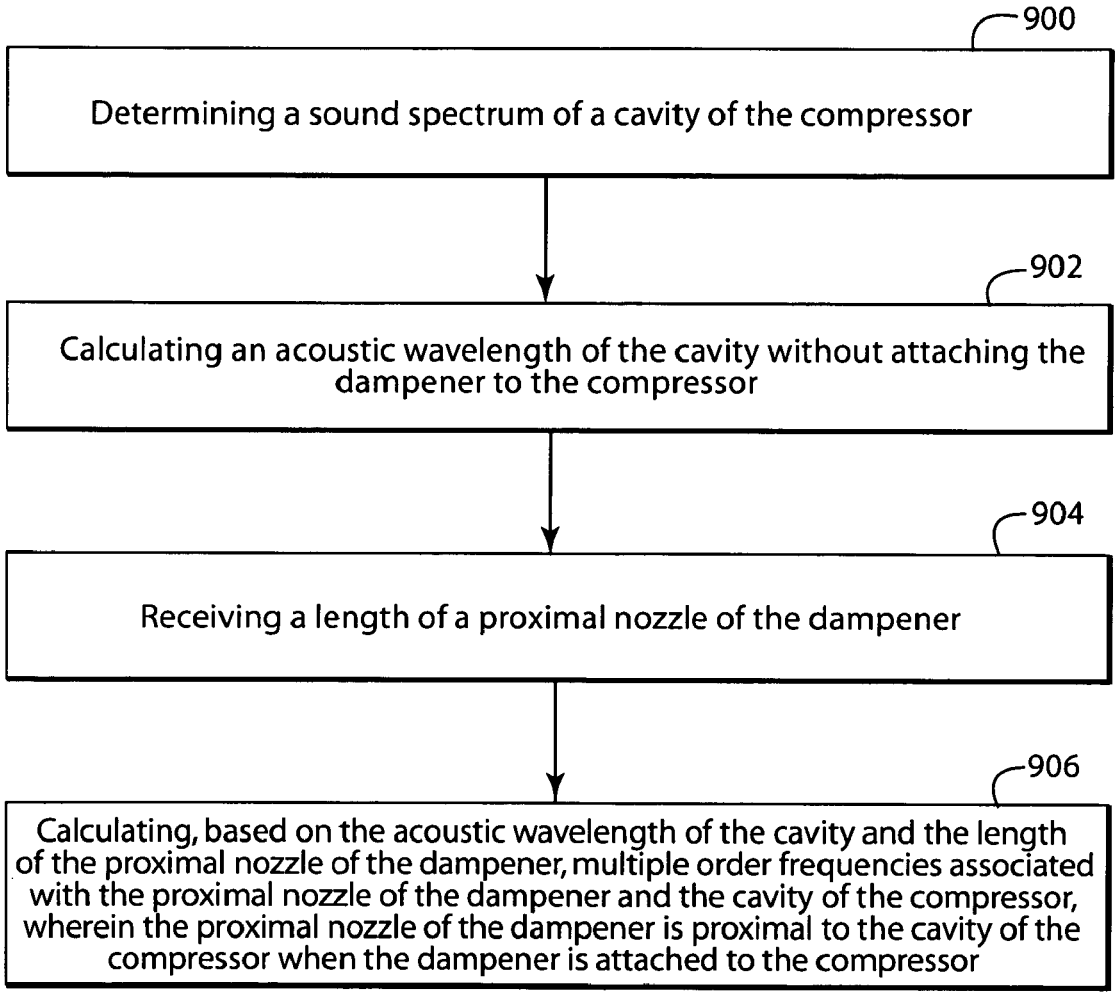
FIG. 9 is a flow chart illustrating steps of a method for calculating the frequencies of various components of the compressor system according to an exemplary embodiment.

According to another exemplary embodiment, there is a method for determining frequencies of various components of a dampener to be attached to a compressor. The steps of such method are shown in FIG. 9. The method includes a step 900 of determining a sound spectrum of a cavity of the compressor without attaching the dampener to the compressor, a step 902 of calculating an acoustic wavelength of the cavity, a step 904 of receiving a length of a proximal nozzle of the dampener, and a step 906 of calculating, based on the acoustic wavelength of the cavity and the length of the proximal nozzle of the dampener, multiple order frequencies associated with the proximal nozzle of the dampener and the cavity of the compressor, wherein the proximal nozzle of the dampener is proximal to the cavity of the compressor when the dampener is attached to the compressor.

Figure 10:
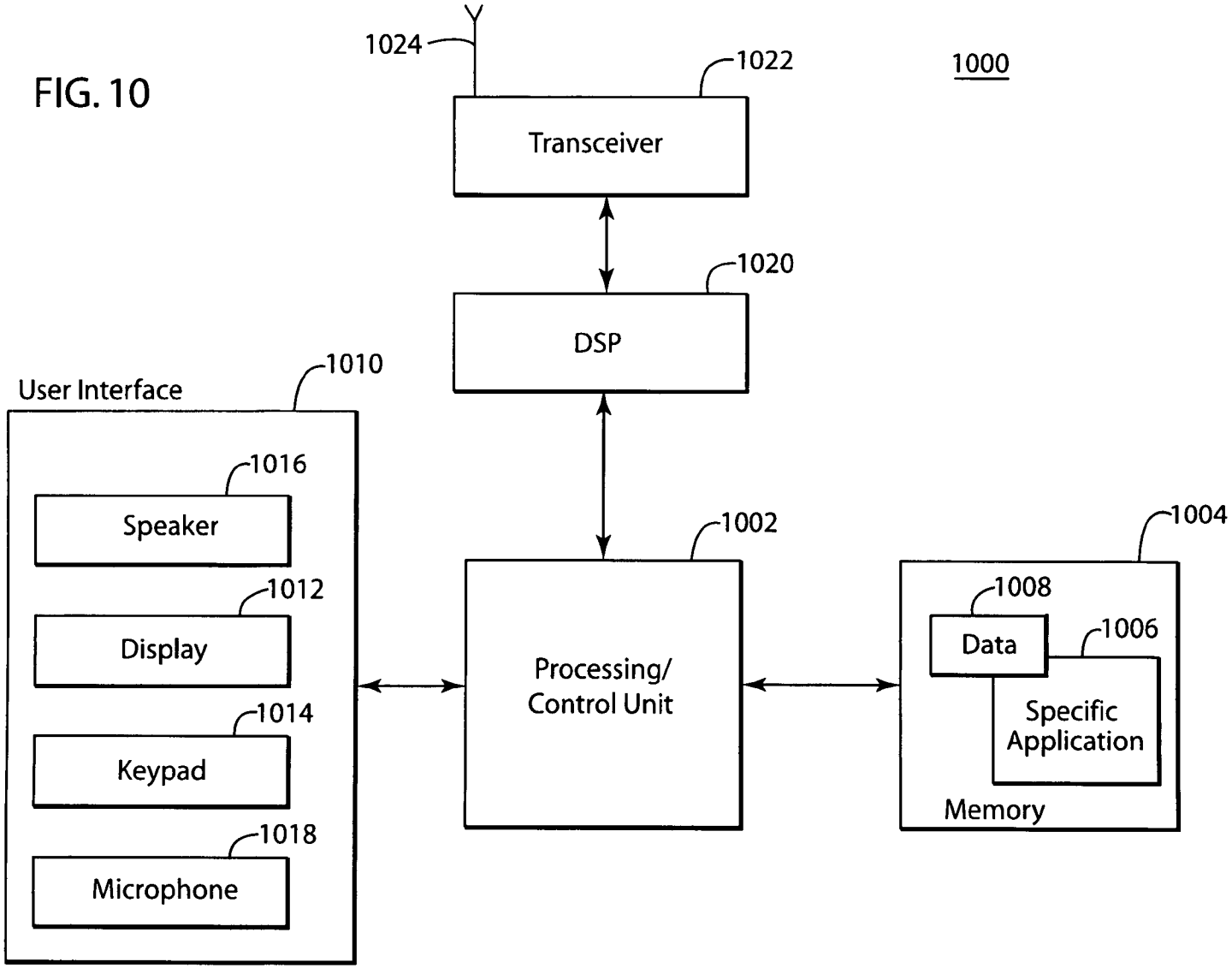
FIG. 10 is a schematic diagram of a computing system used by the testing system.

For purposes of illustration and not of limitation, an example of a representative computing system capable of carrying out operations in accordance with the exemplary embodiments is illustrated in FIG. 10. It should be recognized, however, that the principles of the present exemplary embodiments are equally applicable to other computing systems.

The exemplary computing system 1000 may include a processing/control unit 1002, such as a microprocessor, reduced instruction set computer (RISC), or other central processing module. The processing unit 1002 need not be a single device, and may include one or more processors. For example, the processing unit 1002 may include a master processor and associated slave processors coupled to communicate with the master processor.

The processing unit 1002 may control the basic functions of the system as dictated by programs available in the storage/memory 1004. Thus, the processing unit 1002 may execute the functions described in FIGS. 7 and 8. More particularly, the storage/memory 1004 may include an operating system and program modules for carrying out functions and applications on the computing system. For example, the program storage may include one or more of read-only memory (ROM), flash ROM, programmable and/or erasable ROM, random access memory (RAM), subscriber interface module (SIM), wireless interface module (WIM), smart card, or other removable memory device, etc. The program modules and associated features may also be transmitted to the computing system 1000 via data signals, such as being downloaded electronically via a network, such as the Internet.

One of the programs that may be stored in the storage/memory 1004 is a specific program 1006. As previously described, the specific program 1006 may interact with tables stored in the memory to determine the appropriate characteristics of the gas (air) used when measuring the sound spectrum and also the sizes of the components of the dampeners. The program 1006 and associated features may be implemented in software and/or firmware operable by way of the processor 1002. The program storage/memory 1004 may also be used to store gas and/or dampeners data 1008, or other data associated with the present exemplary embodiments. In one exemplary embodiment, the programs 1006 and data 1008 are stored in non-volatile electrically-erasable, programmable ROM (EEPROM), flash ROM, etc. so that the information is not lost upon power down of the computing system 1000.

The processor 1002 may also be coupled to user interface 1010 elements. The user interface elements 1010 may include, for example, a display 1012 such as a liquid crystal display, a keypad 1014, speaker 1016, and a microphone 1018. These and other user interface components are coupled to the processor 1002 as is known in the art. The keypad 1014 may include alpha-numeric keys for performing a variety of functions, including dialing numbers and executing operations assigned to one or more keys. Alternatively, other user interface mechanisms may be employed, such as voice commands, switches, touch pad/screen, graphical user interface using a pointing device, trackball, joystick, or any other user interface mechanism.

The computing system 1000 may also include a digital signal processor (DSP) 1020. The DSP 1020 may perform a variety of functions, including analog-to-digital (A/D) conversion, digital-to-analog (D/A) conversion, speech coding/ decoding, encryption/decryption, error detection and correction, bit stream translation, filtering, sound processing, etc. The transceiver 1022, generally coupled to an antenna 1024, may transmit and receive the radio signals associated with a wireless device.

The computing system 1000 of FIG. 10 is provided as a representative example of a computing environment in which the principles of the present exemplary embodiments may be applied. From the description provided herein, those skilled in the art will appreciate that the present invention is equally applicable in a variety of other currently known and future mobile and fixed computing environments. For example, the specific application 1006 and associated features, and data 1008, may be stored in a variety of manners, may be operable on a variety of processing devices, and may be operable in mobile devices having additional, fewer, or different supporting circuitry and user interface mechanisms. It is noted that the principles of the present exemplary embodiments are equally applicable to non-mobile terminals, i.e., landline computing systems.

The disclosed exemplary embodiments provide a computing system, a method and a computer program product for determining and selecting frequencies of the dampeners components that will minimize an interaction with the pole pass frequencies and/or natural resonance frequencies of the compressor. It should be understood that this description is not intended to limit the invention and may be applied not only to a screw compressor but to other kind of compressors. Further, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

The exemplary embodiments may take the form of an entirely hardware embodiment or an embodiment combining hardware and software aspects. Further, the exemplary embodiments may take the form of a computer program product stored on a computer-readable storage medium having computer-readable instructions embodied in the medium. Any suitable computer readable medium may be utilized including hard disks, CD-ROMs, digital versatile disc (DVD), optical storage devices, or magnetic storage devices such a floppy disk or magnetic tape. Other non-limiting examples of computer readable media include flash-type memories or other known memories.

Although the features and elements of the present exemplary embodiments are described in the embodiments in particular combinations, each feature or element can be used alone without the other features and elements of the embodiments or in various combinations with or without other features and elements disclosed herein. The methods or flow charts provided in the present application may be implemented in a computer program, software, or firmware tangibly embodied in a computer-readable storage medium for execution by a specifically programmed computer or processor.

What is claimed is:

1. A method for determining frequencies of various components of a dampener to be attached to a compressor, the method comprising:

determining a sound spectrum of a cavity of the compressor without attaching the dampener to the compressor;

calculating an acoustic wavelength of the cavity;

receiving a length of a proximal nozzle of the dampener; and calculating, based on the acoustic wavelength of the cavity and the length of the proximal nozzle of the dampener, multiple order frequencies associated with the proximal nozzle of the dampener and the cavity of the compressor, wherein the proximal nozzle of the dampener is proximal to the cavity of the compressor when the dampener is attached to the compressor.

2. The method of claim 1, wherein the cavity is an inlet cavity or a discharge cavity of the compressor.

3. The method of claim 1, wherein the step of calculating an acoustic wavelength comprises:

calculating an acoustic speed of a gas inside the cavity of the compressor while the compressor is at rest.

4. The method of claim 3, wherein the step of calculating an acoustic wavelength further comprises:

identifying peak frequencies in the sound spectrum;

calculating frequency differences between the adjacent peak frequencies;

calculating an average frequency difference of the frequency differences; and calculating the acoustic wavelength as a ratio of the acoustic speed and the average frequency difference.

5. The method of claim 1, wherein the step of determining comprises:

attaching a speaker and a microphone to a flange of a tube, which is attached to the cavity of the compressor; and recording a sound reflected by the cavity from an initial sound emitted by the speaker into the tube.

6. The method of claim 1, further comprising:

receiving at least one of a cross-wall length of an axial chamber of the dampener, an axial chamber length of the axial chamber, and a choke tube length of a choke tube, wherein the axial chamber of the dampener is displaced distal from an end of the dampener that is connected to the compressor, between the choke tube and a distal nozzle of the dampener, and the choke tube is displaced inside the dampener, between the proximal nozzle and the distal nozzle of the dampener.

7. The method of claim 6, further comprising:

calculating corresponding multiple order frequencies for the cross-wall length, the axial chamber length and the choke tube length.

8. The method of claim 7, further comprising:

calculating multiple lobe pass frequencies associated with a male rotor and a female rotor of the compressor; and determining whether the calculated multiple order frequencies of the proximal nozzle, the axial chamber, and the choke tube are spaced apart from the multiple lobe pass frequencies by at least a predetermined value.

9. The method of claim 8, further comprising:

modifying at least one of the length of the proximal nozzle, the cross-wall length of the axial chamber, the axial chamber length of the axial chamber, and the choke tube length of the choke tube.

10. The method of claim 8, further comprising:

plotting the corresponding multiple order frequencies for the cross-wall length, the axial chamber length and the choke tube length and the multiple lobe pass frequencies associated with a male rotor and a female rotor of the compressor as an acoustic Campbell diagram.

11. A non-transitory tangible computer readable medium including computer executable instructions, wherein the instructions, when executed in a processor, implement a method for determining frequencies of various components of a volume choke volume dampener to be attached to a compressor, the method comprising:

providing a system comprising distinct software modules, wherein the distinct software modules comprise a frequency calculation module, a special calculation module, and an acoustic Campbell module;

determining a sound spectrum of a cavity of the compressor without attaching the dampener to the compressor;

calculating by the frequency calculation module an acoustic wavelength of the cavity;

receiving a length of a proximal nozzle of the dampener; and calculating by the special calculation module, based on the acoustic wavelength of the cavity and the length of the proximal nozzle of the dampener, multiple order frequencies associated with the proximal nozzle of the dampener and the cavity of the compressor, wherein the proximal nozzle of the dampener is proximal to the cavity of the compressor when the dampener is attached to the compressor.

12. The medium of claim 11, wherein the step of calculating an acoustic wavelength comprises:

calculating an acoustic speed of a gas inside the cavity of the compressor while the compressor is at rest.

13. The medium of claim 12, wherein the step of calculating an acoustic wavelength further comprises:

identifying peak frequencies in the sound spectrum; calculating in the frequency calculation module frequency differences between the adjacent peak frequencies;

calculating an average frequency difference of the frequency differences; and calculating in the special calculation module the acoustic wavelength as a ratio of the acoustic speed and the average frequency difference.

14. The medium of claim 11, wherein the step of determining comprises:

attaching a speaker and a microphone to a flange of a tube, which is attached to the cavity of the compressor; and recording a sound reflected by the cavity from an initial sound emitted by the speaker into the tube.

15. The medium of claim 11, further comprising:

receiving at least one of a cross-wall length of an axial chamber of the dampener, an axial chamber length of the axial chamber, and a choke tube length of a choke tube, wherein the axial chamber of the dampener is displaced distal from an end of the dampener that is connected to the compressor, between the choke tube and a distal nozzle of the dampener, and the choke tube is displaced inside the dampener, between the proximal nozzle and the distal nozzle of the dampener.

16. The medium of claim 15, further comprising:

calculating in the special calculation module corresponding multiple order frequencies for the cross-wall length, the axial chamber length and the choke tube length.

17. The medium of claim 16, further comprising:

calculating in the special calculation module multiple lobe pass frequencies associated with a male rotor and a female rotor of the compressor; and determining whether the calculated multiple order frequencies of the proximal nozzle, the axial chamber, and the choke tube are spaced apart from the multiple lobe pass frequencies by at least a predetermined value.

18. The medium of claim 17, further comprising:

modifying at least one of the length of the proximal nozzle, the cross-wall length of the axial chamber, the axial chamber length of the axial chamber, and the choke tube length of the choke tube.

19. The medium of claim 17, further comprising:

plotting by the acoustic Campbell module the corresponding multiple order frequencies for the cross-wall length, the axial chamber length and the choke tube length and the multiple lobe pass frequencies associated with a male rotor and a female rotor of the compressor as an acoustic Campbell diagram.

20. A computer system for determining frequencies of various components of a dampener to be attached to a compressor, the computer system comprising:

a processor configured to, determine a sound spectrum of a cavity of the compressor without attaching the dampener to the compressor, calculate an acoustic wavelength of the cavity, receive a length of a proximal nozzle of the dampener, and calculate, based on the acoustic wavelength of the cavity and the length of the proximal nozzle of the dampener, multiple order frequencies associated with the proximal nozzle of the dampener and the cavity of the compressor, wherein the proximal nozzle of the dampener is proximal to the cavity of the compressor when the dampener is attached to the compressor.

* * * * *